United States Patent [19]

Cox

[11] 4,098,371

[45] Jul. 4, 1978

[54] MOBILE SCAFFOLD

[75] Inventor: Edward G. Cox, Cedar Rapids, Iowa

[73] Assignee: FMC Corporation, San Jose, Calif.

[21] Appl. No.: 752,237

[22] Filed: Dec. 20, 1976

[51] Int. Cl.[2] ..... B66F 11/04

[52] U.S. Cl. ..... 182/2; 182/37; 182/38

[58] Field of Search ..... 182/2, 12, 13, 14, 36, 182/37, 38, 82; 214/DIG. 11

[56] References Cited

U.S. PATENT DOCUMENTS

| | | | |
|---|---|---|---|
| 2,674,500 | 4/1954 | Hukari | 182/2 |
| 2,736,445 | 2/1956 | Hoban | 214/DIG. 11 |
| 3,124,213 | 3/1964 | Jorsey | 182/13 |

FOREIGN PATENT DOCUMENTS

| | | | |
|---|---|---|---|
| 1,337,059 | 11/1973 | United Kingdom | 182/2 |

*Primary Examiner*—Reinaldo P. Machado

*Attorney, Agent, or Firm*—J. F. Verhoeven; J. W. Edwards

[57] ABSTRACT

A mobile scaffold has a carriage for traversing longitudinally a first track and a second track. The carriage is suspended from the first track. Lateral support for one side of the carriage is provided by the second track, and this track is spaced vertically from the first track. A parallel arm type crane has one end mounted to the carriage on a side that is opposite from the side adjacent the second track. Attached to the end of the crane extended outwardly from the carriage is an operator's platform. The crane can swing to position the platform both in elevation and in a direction lateral of the carriage. The carriage has a vertical drive shaft with a horizontal wheel mounted thereon for contacting the second track. Bearings fit about the vertical drive shaft and the end of the crane is attached to the bearings so as to swing about the drive shaft.

4 Claims, 13 Drawing Figures

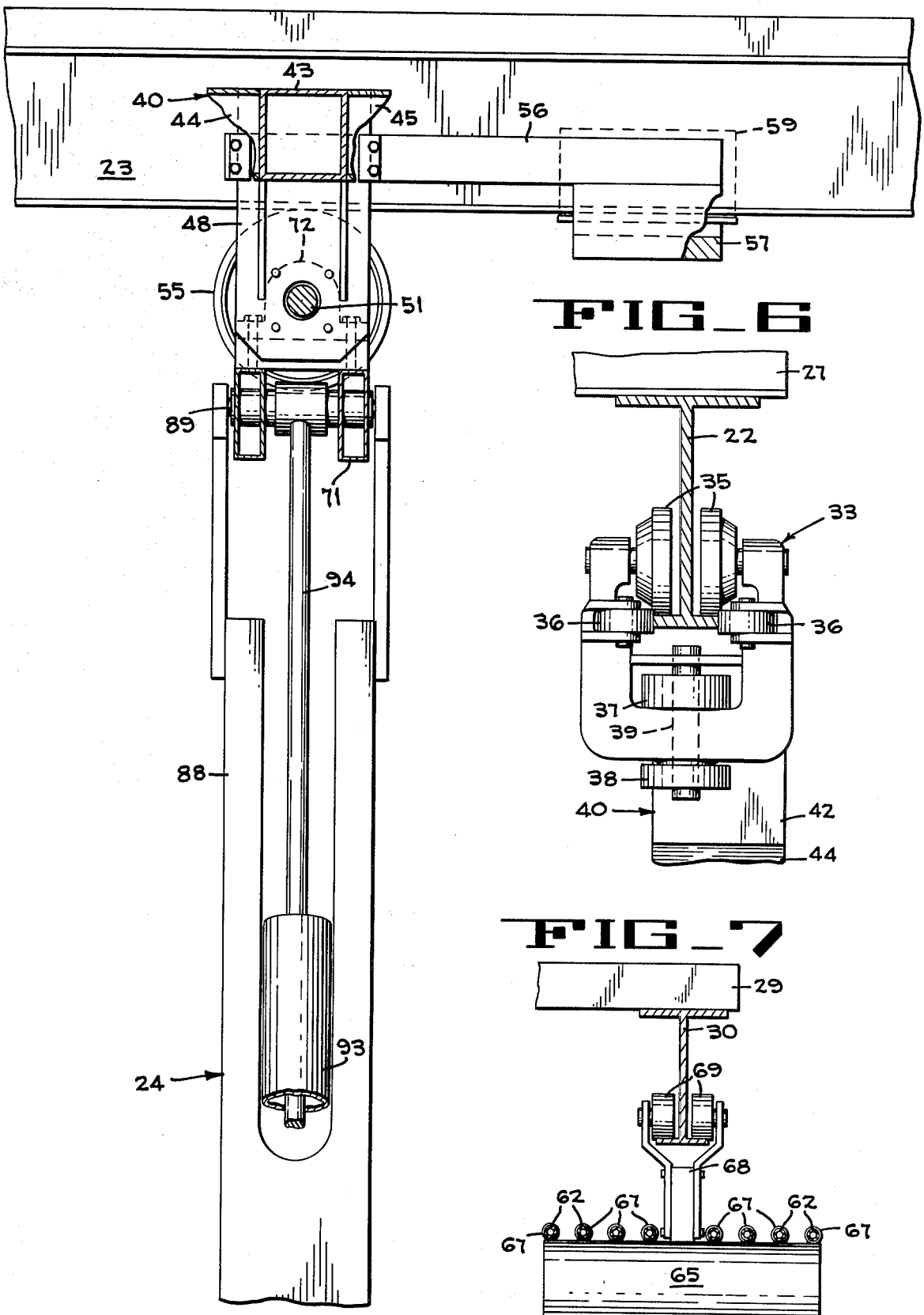
FIG_8
FIG_6
FIG_7
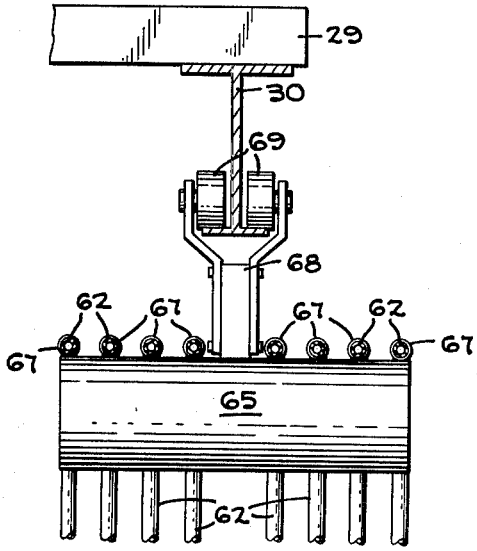

MOBILE SCAFFOLD

BACKGROUND OF THE INVENTION

1. Field of the Invention

This invention relates to a mobile scaffold that longitudinally traverses a first track and a vertically spaced second track. More specifically, the invention pertains to such a scaffold with means for positioning an operator's platform both in elevation and in a lateral direction relative to the tracks.

2. Description of the Prior Art

In a manufacturing plant for large machines, such as cranes, there existed a problem of positioning painters for painting the machines within a paint booth. Ladders were considered to be unsafe at the heights required, particularly when used on an open grating of a down-draft paint booth or on the rough deck of a railroad flat car. Scaffolds and platforms could be used for a limited number of machine sizes, but where a wide variety of different size machines arrive at the work area in random order, such structure is unacceptable from the standpoint of safety, flexibility, and maintainability because this approach requires covering along the entire length of the product line.

Various cranes and other lifting devices have been used for positioning painters or other workmen at a work area. U.S. Pat. No. 3,357,517, that issued to Wagner on Dec. 12, 1967, shows a painter's mobile scaffold with two parallelogram lifts that are interconnected by an intermediate support member for horizontal rotation of the lowermost lift relative to the uppermost lift. The uppermost lift is attached to a vehicle that travels along a bridge deck, while the lowermost lift supports a platform for positioning a painter to paint the underside of the bridge deck. A platform positioning mechanism for use while working upon airplanes is shown in U.S. Pat. No. 3,602,335 that issued to Gustetic on Aug. 31, 1971. An upper base, that is mounted by beams and rollers for horizontal movement near a room ceiling, has a vertical mast depending therefrom. This mast includes a movable telescopic portion upon which is mounted a vertically slidable carriage. Supported upon the carriage is an operator's platform for rotation in a horizontal plane about the carriage.

U.S. Pat. No. 3,043,395, that issued to Volkel on July 10, 1962, shows a parallelogram lift that is mounted at one end upon a carriage and this lift supports at its outer end an operator's cage. A cylinder, controlled from the operator's cage, actuates the lift for up and down movement of the lift. Other patents that show lifts with parallelogram linkages include U.S. Pat. No. 3,176,792 that issued on Olson on Apr. 6, 1965, U.S. Pat. No. 3,534,832 that issued to Rediske on Oct. 20, 1970, and U.S. Pat. No. 3,807,575 that issued to Merrick on Apr. 30, 1974. A traveling overhead crane that supports an up-draft paint booth for painting airplanes is shown in U.S. Pat. No. 2,829,582 that issued to Abbott et al. on Apr. 8, 1958.

All of the patents mentioned above require a carriage for longitudinal travel along a floor or a ceiling. Near the floor of a down-draft paint booth, lateral clearance between a booth side wall and a large machine to be painted should be limited to reduce the volume of air required for circulation within the paint booth. Thus, a mobile scaffold must be able to fit within the limited lateral clearance. Furthermore, the carriage should not block the air flow through the open grating at the floor of the booth. Carriages that are mounted to travel along high ceilings require a substantial depth of an intermediate support structure to position a painter's platform near a work area, and such structure adds to the cost of the mobile scaffold. The ambient conditions within a paint booth make the booth an extreme fire hazard area. These factors had to be considered in developing the mobile scaffold that is disclosed in this application.

SUMMARY OF THE INVENTION

Advantages of the present invention include the ability to fit within a narrow space between a paint booth side wall and a side of a machine to be painted, no structure blocking the flow of air below the painter's platform, the ability to position a painter at any desired location within the area to be served by the mobile scaffold, the ability to be used safely within an area where there is an extreme fire hazard due to explosive or combustible gases, and a structure that is economically feasible to both manufacture and operate.

In order to fit within the narrow space between a paint booth side wall and a side of a machine to be painted, the present invention provides a carriage that is mounted for travel longitudinally along a first track, from which the carriage is suspended, and a second track, that is spaced vertically from the first track to provide lateral support for the carriage along the side wall. This carriage has a frame that extends vertically between the tracks and longitudinally along the tracks. The least dimension of the carriage is in a lateral direction. The carriage has a parallel-arm type crane that is connected between the carriage and an operator's platform for positioning the operator's platform both in elevation and in a lateral direction from the carriage. Since this crane can be swung to position the operator's platform at a location near the tracks, the platform can fit within narrow clearances between the side wall and the largest machine to be painted within the paint booth. The platform can then be swung vertically from a position near the floor to an elevation above the top of the machine.

The structural arrangement of the carriage drive and the parallel-arm type crane provides a mounting with a minimized lateral dimension and the ability to swing the crane laterally through a horizontal arc. This is accomplished by attaching with bearings the carriage end of the crane to a vertical drive shaft upon the carriage, to permit the crane to swing about the drive shaft. A horizontal wheel that is attached to the drive shaft engages the second track which laterally supports the carriage. This horizontal wheel drives the carriage along the second track.

To enable the carriage to operate safely within an extreme fire hazard area, the power source for driving the carriage is hydraulic and the wheels for contacting the tracks are made of spark-proof bronze and stainless steel. Hydraulic power is also used for pivoting the parallel-arm type crane to swing both vertically and laterally.

BRIEF DESCRIPTION OF THE DRAWINGS

FIG. 6 is a section taken on the line 6—6 of FIG. 3.

FIG. 7 is a section taken on the line 7—7 of FIG. 3.

FIG. 8 is a section taken on the line 8—8 of FIG. 3.

DESCRIPTION OF THE PREFERRED EMBODIMENT

Figure 1:
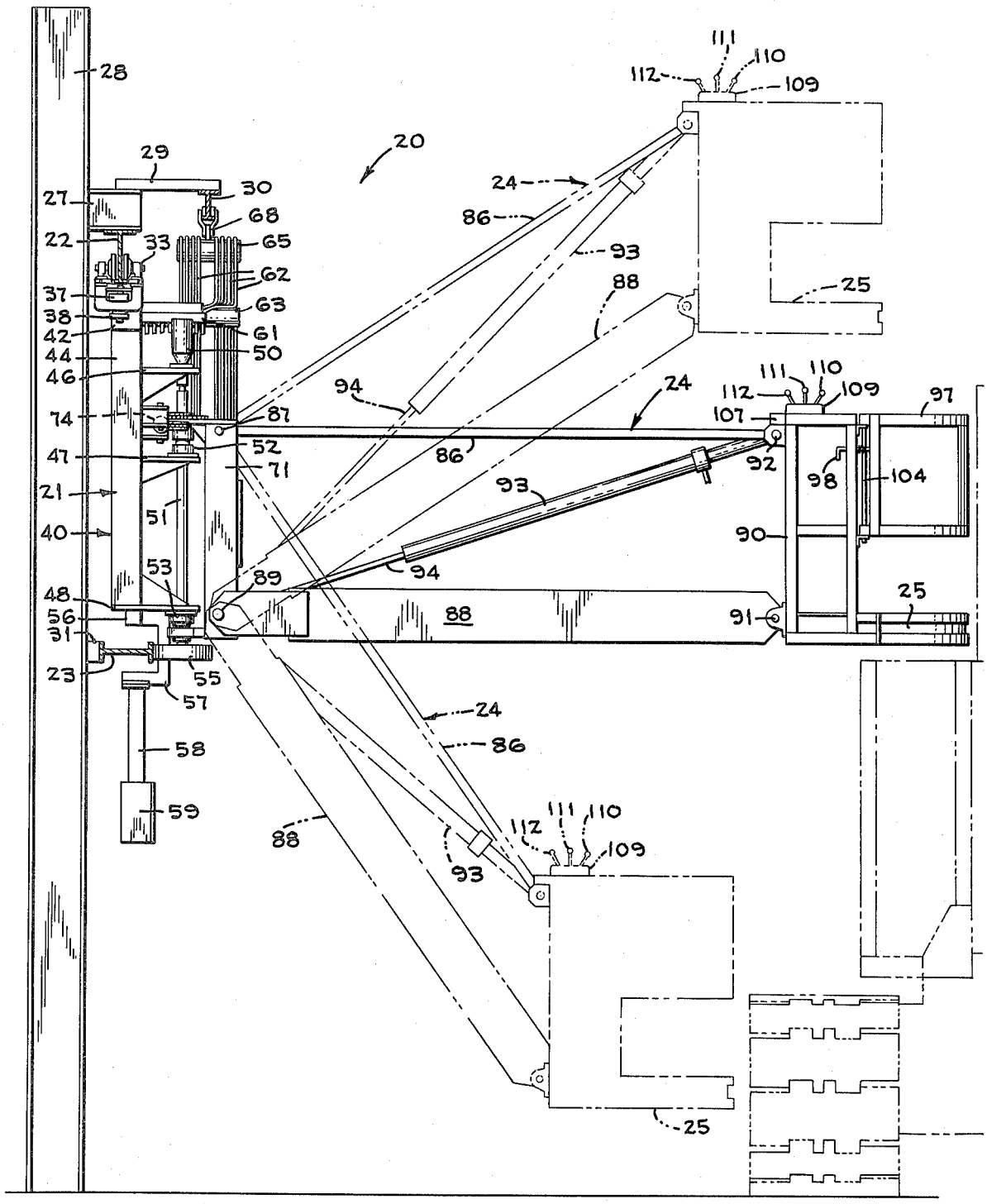
FIG. 1 is a front view of a mobile scaffold embodying the present invention with upper and lower positions of a parallel-arm type crane and an operator's platform being shown in phantom line.
Figure 2:
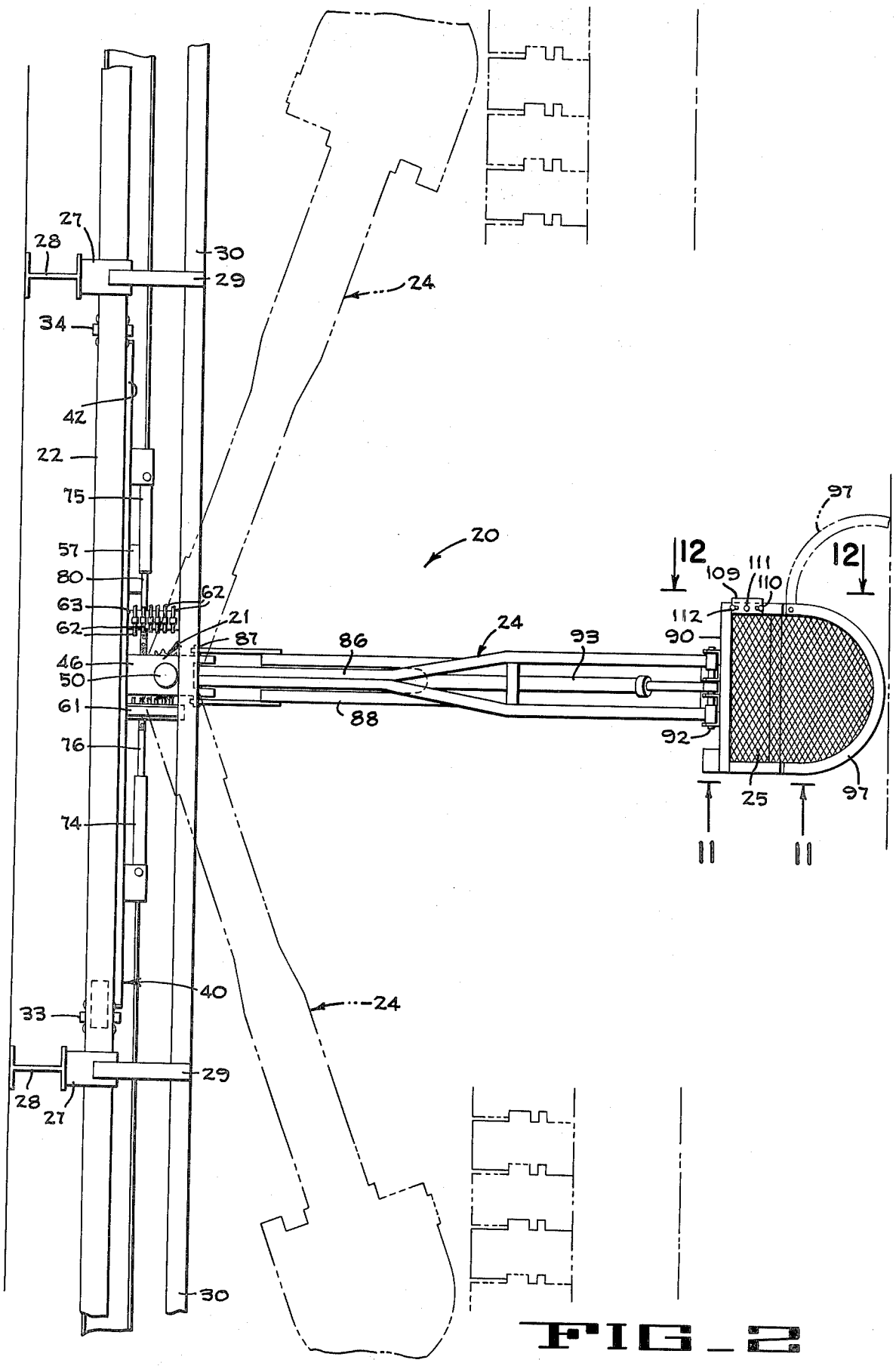
FIG. 2 is a plan view of the mobile scaffold shown in FIG. 1 with forward and rearward positions of the parallel-arm type crane and the operator's platform being shown in phantom line.
Figures 3, 4:
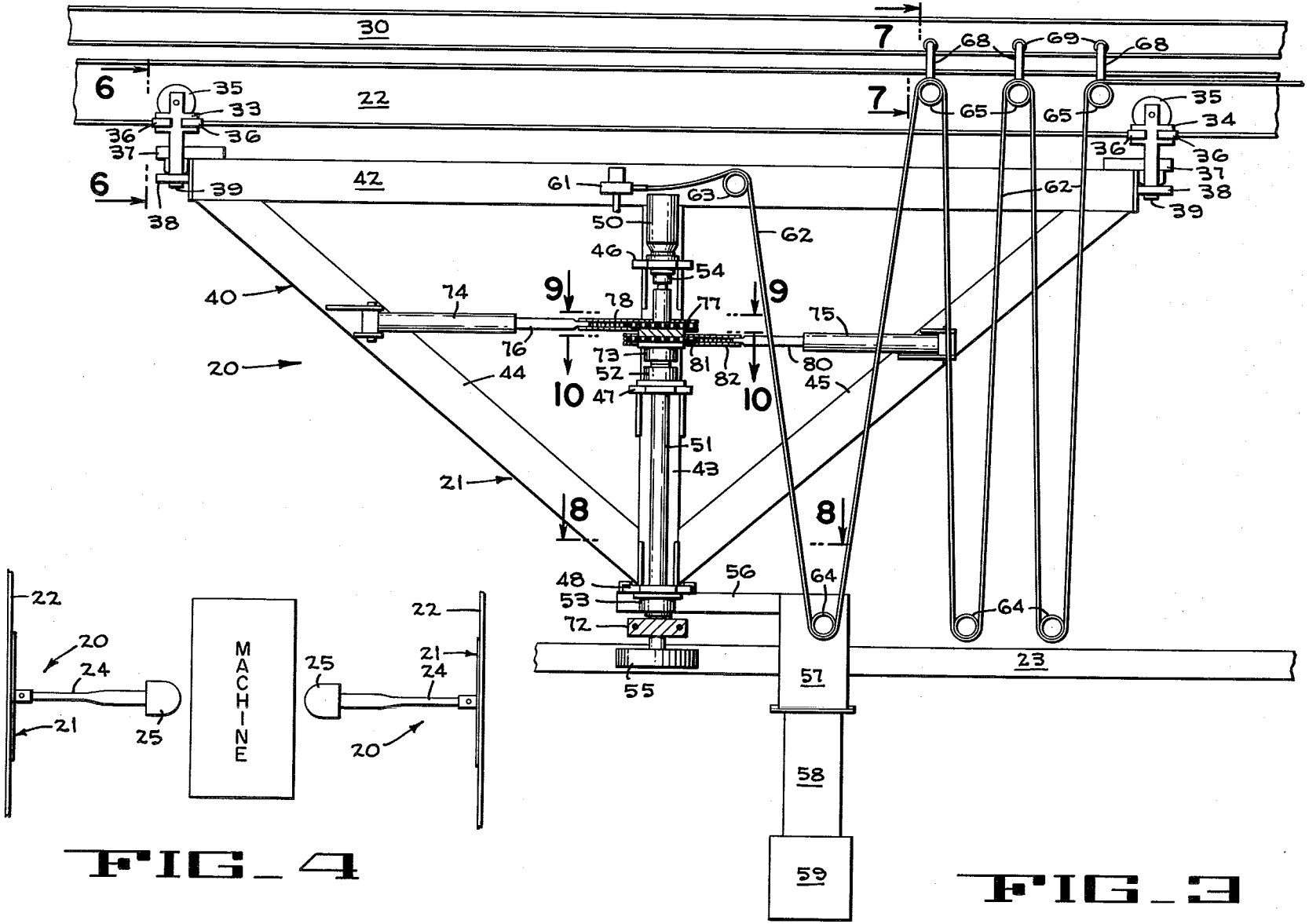
FIG. 3 is a side elevation view of the mobile scaffold shown in FIG. 1 with the parallel-arm type crane and the operator's platform being removed.
FIG. 4 is a diagrammatic plan view of a portion of a paint booth wherein a pair of mobile scaffolds are positioned on opposite side walls of the booth to facilitate painting opposite sides of a machine.
Figure 5:
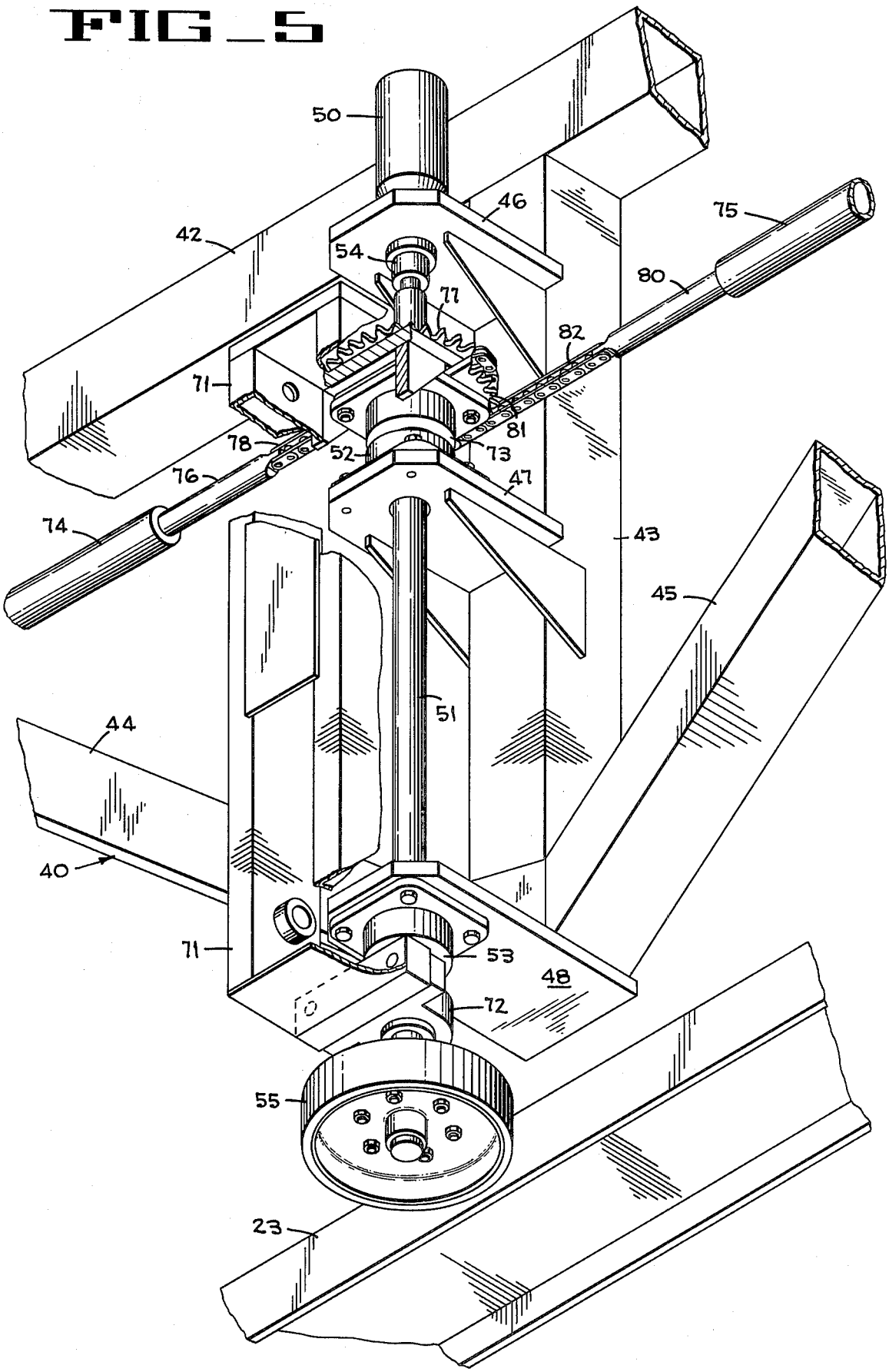
FIG. 5 is a perspective view of a portion of the mobile scaffold carriage showing a vertical drive shaft, a horizontal drive wheel, and the structure connecting the parallel-arm type crane to the drive shaft for pivotal movement thereabout.

With reference to FIG. 1, a mobile scaffold 20 has a carriage 21 for traversing longitudinally a first track 22 and a second track 23. The carriage is suspended from the first track. Lateral support for one side of the carriage is provided by the second track that is spaced vertically from the first track. A parallel-arm type crane 24 has one end pivotally mounted to the carriage on a side that is opposite from the carriage side adjacent the second track. The outwardly extending end of the crane has an operator's platform 25 attached thereto. The crane can swing to position the platform both in elevation, as shown in FIG. 1, and in a direction lateral of the carriage, as shown in FIG. 2. A pair of mobile scaffolds can be positioned on opposite sides of a paint booth, as shown in FIG. 4, to position painters for painting each side of a machine. Since both scaffolds are similar, only one shall be described in detail.

The first track 22, a monorail, is suspended from hangers 27 that project laterally from columns within a wall or partition 28. Track hangers 29 project laterally outward from the hangers 27 and support an I-beam 30. The second track 23 is mounted by track brackets 31 to the wall or partition, and this second track is spaced vertically from the first track.

The carriage 21 has a monorail trolley 33 and a monorail trolley 34, as shown in FIG. 3, spaced longitudinally along the first track 22. These trolleys ride upon a trolley surface at the lower flange of the first track. The trolleys have load carrying wheels 35 made of sparkproof bronze and anti-sway wheels 36 made of sparkproof stainless steel. The trolleys have a U-shaped transverse section, as shown in FIG. 7, that fits between an upper coupling flange 37 and a lower coupling flange 38. The section is held in place between the coupling flanges by a trolley pin 39 that fits through the section and the coupling flanges. The coupling flanges project from a main frame 40, that is shown more clearly in FIG. 3.

The main frame 40 has the shape of a King-type truss beam with a horizontal member 42. The upper coupling flange 37 and the lower coupling flange 38 extend from each end of this member for connection with either the trolley 33 or the trolley 34. A vertical member 43 depends from the mid-point of the horizontal member, and the lowermost end of the vertical member is supported by a pair of diagonal members 44 and 45 that extend from opposite ends of the horizontal member. A top bracket 46, an intermediate bracket 47, and a lower bracket 48 project laterally outward from the vertical member for supporting a carriage drive mechanism.

The carriage drive mechanism includes a reversible hydraulic motor 50 that is mounted upon the top bracket 46. A drive shaft 51 extends through the intermediate bracket 47 and the lower bracket 48 where the drive shaft is supported by bearings 52 and 53, respectively. The drive shaft has a coupling 54 that is located therein near the hydraulic motor. Mounted upon the end of the shaft opposite from the motor is a horizontal drive wheel 55 that engages the second track 23. This drive wheel is forced against the second track in response to the eccentric loading of the carriage by the parallel-arm type crane 24 and the operator's platform 25.

Suspended from the vertical member 43 of the main frame 40 is a bracket 57, shown in FIGS. 1, 3 and 8. This bracket has a longitudinally extending arm 56 that connects with the main frame, while the vertical extending portion of the bracket is C-shaped, to fit about the second track 23. The bracket 57 is made of rectangular tubular material. Extending downward from the bracket 57 is a bracket extension 58 to which an emergency valve box 59 is mounted. This valve box contains emergency controls for the parallel-arm type crane 24. These controls are accessible from floor level. Such controls are to be used to lower the operator's platform 25 to the floor level if for any reason the operator on the platform becomes incapacitated. These emergency controls will be subsequently described with reference to the hydraulic circuitry and operation.

Anchored to the horizontal member 42 of the main frame 40 is a fluids manifold 61. A series of hoses 62 are connected to this manifold, and these hoses extend over a hose hanger 63 that projects outwardly from the horizontal member 42. The hoses extend downward from the hanger 63 to pass under a weighted hose guide 64. The hoses then extend upward over a series of trolley supported hose hangers 65, with weighted hose guides 64 being positioned between the hose hangers to cause the hoses to hang in a festoon-like manner, as shown in FIG. 3. Looking now at FIG. 7, each trolley supported hose hanger has mounted thereon a series of ring guides 67. The hoses 62 are fitted through these ring guides so as to maintain the hoses in laterally spaced positions. A mounting yoke 68 extends upwardly from the hanger to support a pair of trolley wheels 69 that travel along the upper surface of the lower flange of the beam 30. The hose hangers and the hose guides each have laterally spaced ring guides for spacing the hoses which supply hydraulic power, paint, and solvent to the fluids manifold. The hoses 62 extend from the fluids manifold to a remote location where the hoses are connected to a paint supply system and to a hydraulic power supply unit, not shown. Hydraulic lines, not shown, from the fluids manifold extend to the carriage 21 and to the parallel-arm type crane 24. Paint supply lines, not shown, extend from the manifold along the crane to the operator's platform 25.

Figure 9:
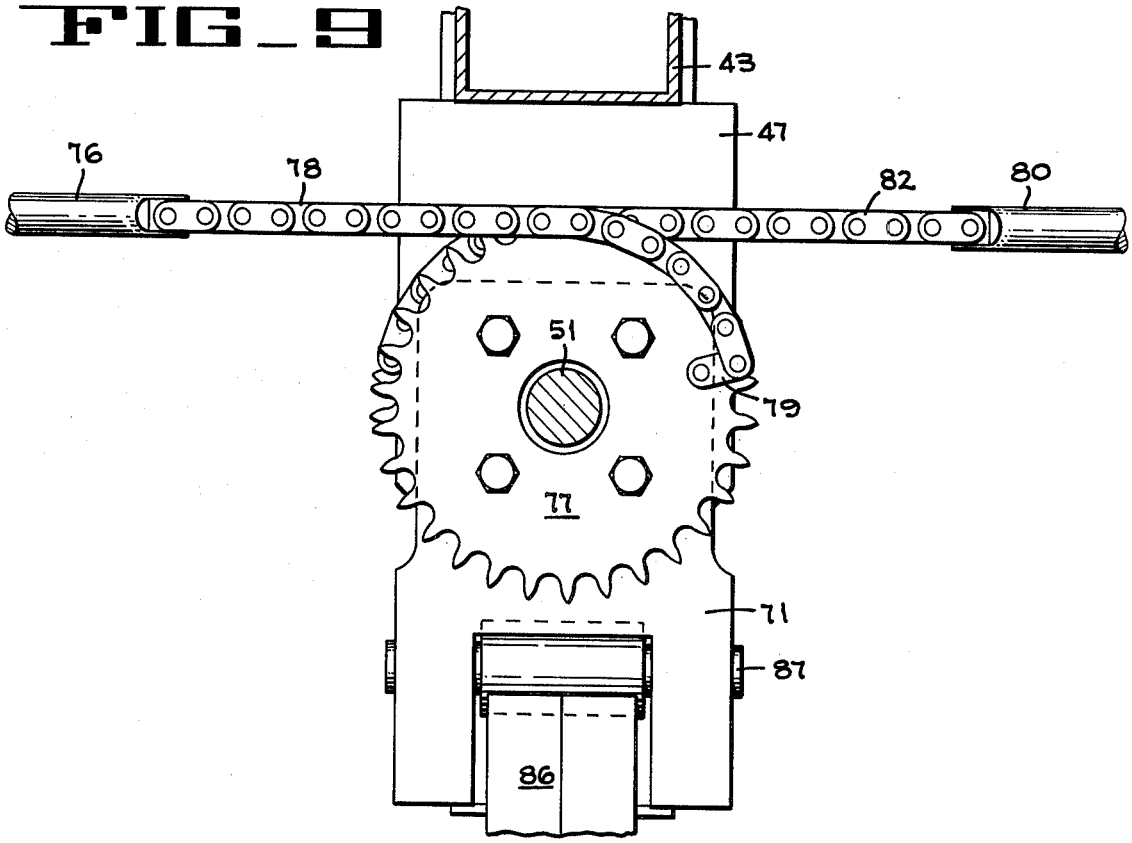
FIG. 9 is a section taken on the line 9—9 in FIG. 3.
Figure 10:
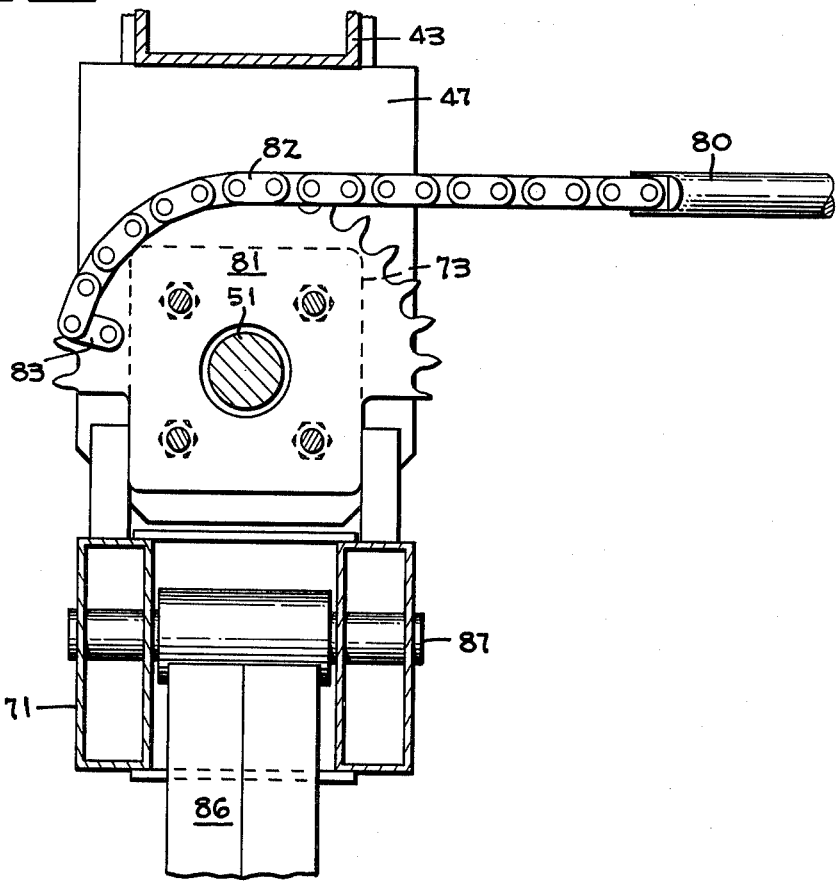
FIG. 10 is a section taken on the line 10—10 in FIG. 3.

The parallel-arm type crane 24 has an end bracket 71 that is rotatably mounted to the drive shaft 51 by means of a pillow block 72 and a flange bearing 73. The pillow block and the flange bearing permit the drive shaft to rotate therein without influencing the radial position of the end bracket. The end bracket can be rotated about the drive shaft by the action of a hydraulic cylinder 74 and a hydraulic cylinder 75, as shown in FIG. 3. The hydraulic cylinder 74 has one end mounted to the diagonal member 44 in a position so that the cylinder rod 76 will extend in alignment with the periphery of a modified sprocket 77. A length of chain 78 extends from the end of the cylinder rod 76 to a link 79 that connects the chain to the sprocket, as shown in FIG. 9. The hydraulic cylinder 75 has one end connected to the diagonal member 45 in a position so that a cylinder rod 80 will extend in alignment with the periphery of a modified sprocket 81, as shown in FIG. 10. A length of roller chain 82 extends from one end of the cylinder rod 80 about a peripheral portion of the sprocket 81 to a link 83 that attaches the roller chain to that sprocket.

The hydraulic cylinders 74 and 75 are cross-connected so that as one cylinder rod extends, the other cylinder rod retracts. As the cylinder rod retracts, the connected roller chain is unwrapped from the connected sprocket, causing the connected sprocket to rotate. The opposite chain is wound upon its associated sprocket due to rotation thereof as the first chain is unwound from its connected sprocket. The modified sprockets 77 and 81 are bolted to the end bracket 71 to cause the parallel-arm type crane 24 to swing horizontally about the vertical drive shaft 51. The parallel-arm type crane has a tie bar 86 that is pivotally connected at one end to the end bracket by a pin 87. A support arm 88 is connected to the floor portion of the end bracket by a pin 89 and this support arm extends outwardly parallel with the tie bar to the operator's platform 25. The operator's platform has an upright back 90 to which the support arm is connected by a pin 91 and the tie bar is connected by a pin 92. This upright back is parallel with the end bracket. Thus, it will be seen that a parallelogram is formed by the parallel members of the parallel-arm type crane. This crane also has a hydraulic cylinder 93 and an actuating arm 94 that extend on the diagonal of the parallelogram. As the actuating arm is extended from the hydraulic cylinder, the operator's platform will be elevated, while retraction of the actuating arm into the hydraulic cylinder causes the operator's platform to be lowered.

Figure 11:
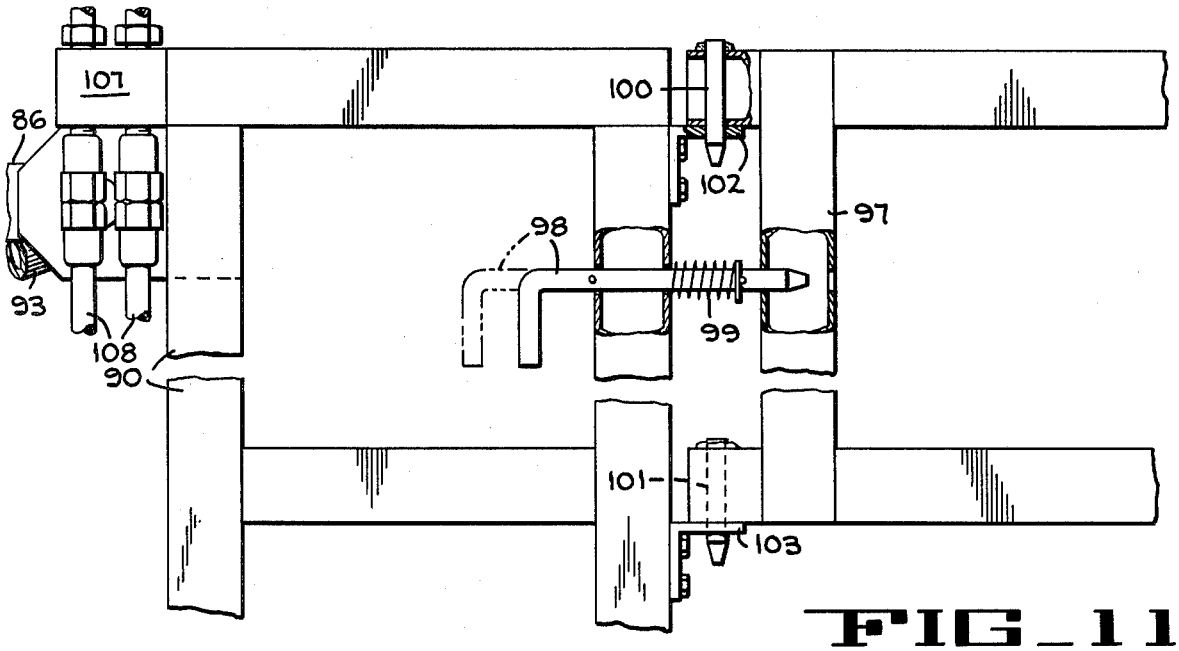
FIG. 11 is a side view in elevation taken on the line 11—11 in FIG. 2.

Attached to the upright back 90 above the operator's platform 25 is a gate 97 that can swing outwardly from the solid line position shown in FIG. 2 to the position shown in phantom line. This gate has a closing and latching mechanism that is designed to make it virtually impossible for the operator to accidentally or inadvertently open the gate. Both hands are required to operate the closing and latching mechanism. The closing and latching mechanism is shown in detail in FIGS. 11 and 12. A locking pin 98 extends horizontally through an upright member of the back 90 into the gate 97. This pin is urged by a spring 99 towards the position in contact with the gate. The pin can be withdrawn to the position shown in phantom line where it is removed from contact with the gate. Then, it is necessary to lift the gate upward to clear the latch pins 100 and 101 that are mounted upon the gate from their respective receiving brackets 102 and 103 that are mounted upon the upright back. The opposite side of the gate is pivotally connected to the back by an elongated gate pin 104 that extends from the gate through brackets 105 and 106 projecting from the back. The elongated gate pin allows the gate to be lifted for clearing the latch pins, before the gate is swung outwardly. When the gate is opened, an operator can enter or leave the enclosure above the operator's platform. The gate requires both hands of the operator for opening. The spring loaded lock pin can be withdrawn and held in the withdrawn position against the spring force with one hand, while at the same time another hand is used to lift the gate vertically approximately 1¼ inches and thereby withdraw the latch pins from their respective receiving brackets.

A paint manifold 107 is mounted upon the upright back 90. Flexible pressure hoses 108 connect the paint manifold with the fluids manifold 61 that is located on the main frame 40. A painter standing upon the operator's platform has available from the paint manifold all the various colors of paint that are required for painting machines. The pressure hoses extend along a parallel-arm type crane 24, and thus, the hazard of a dangling or dragging high pressure paint line being snagged on a machine, as the mobile scaffold passes over the machine is eliminated.

Figure 12:
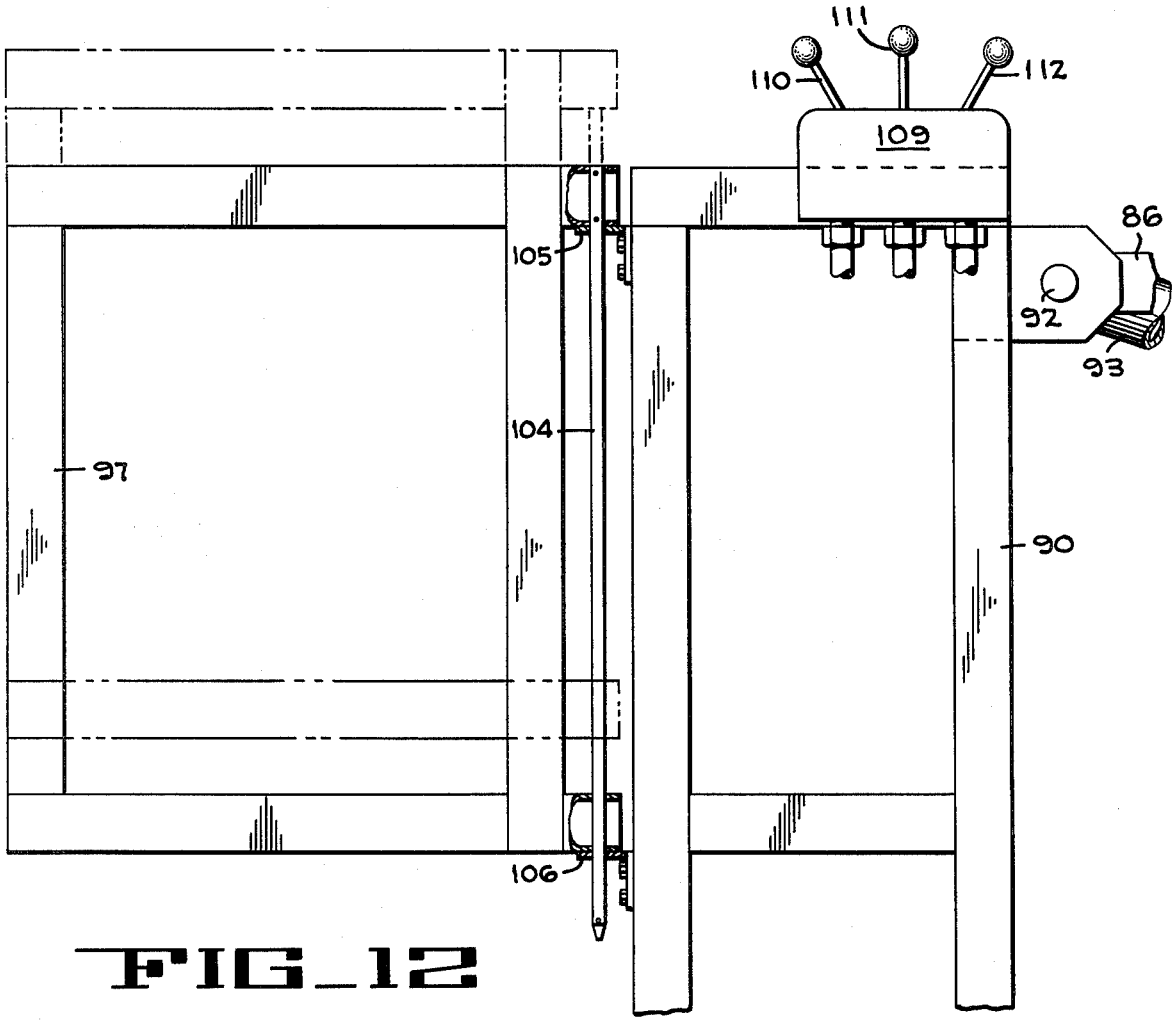
FIG. 12 is a side view in elevation taken on the line 12—12 in FIG. 2.

The operator's platform provides a safe working position for an operator, who has control of the entire mobile scaffold operation by a hydraulic control panel 109. This control panel, that is mounted upon the back 90, has a lever operated control valve 110 which regulates longitudinal travel of the carriage 21 along the tracks 22 and 23. A lever operated control valve 111 regulates the elevation of the crane 24, while a lever operated control valve 112 regulates swing of the crane laterally in a horizontal plane. The position of the control panel and lever operated control valves relative to the operator's platform 25 is shown in FIGS. 1, 2 and 12. The interrelationship of these valves and the hydraulic circuitry is shown in FIG. 13.

Figure 13:
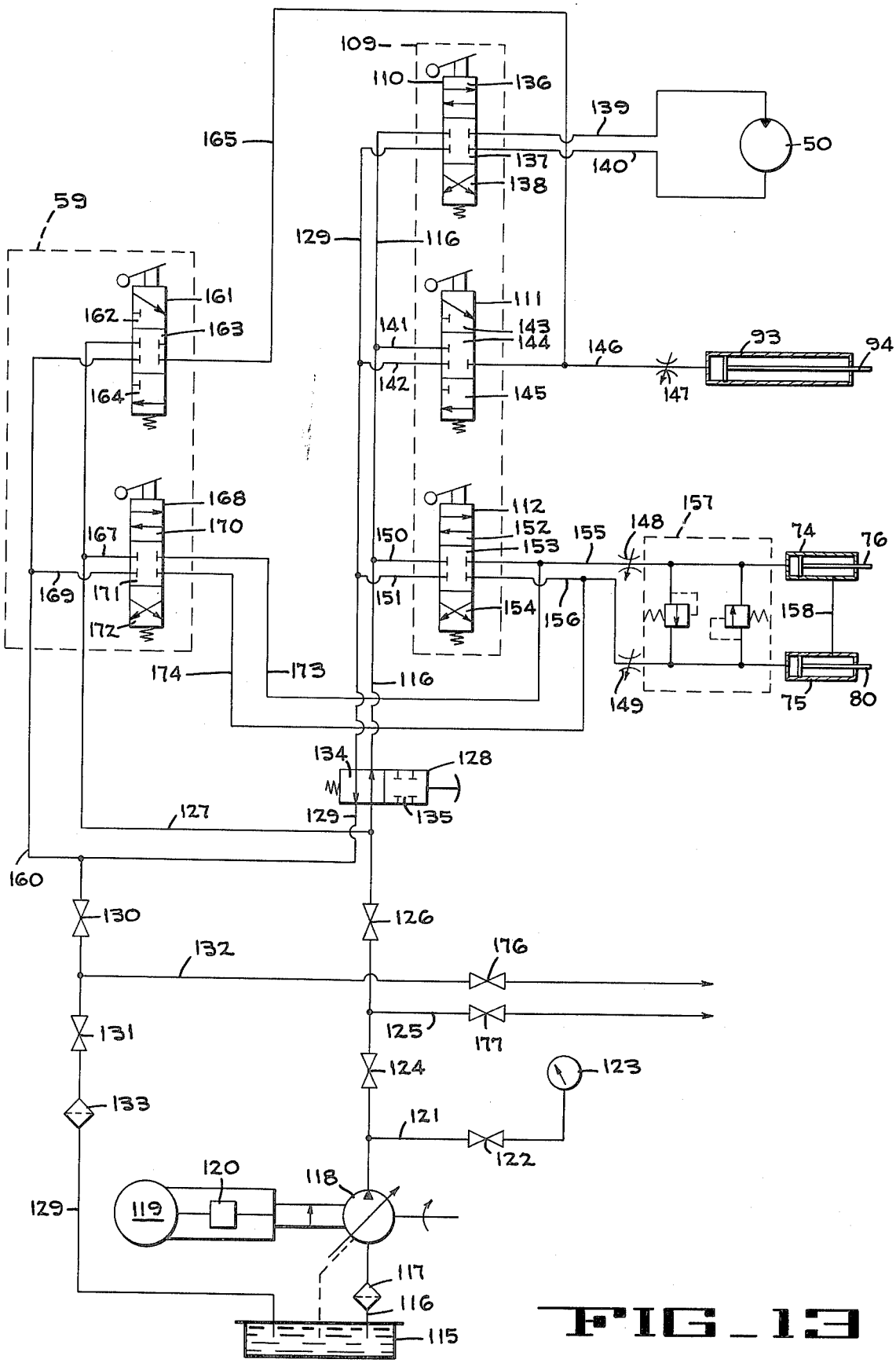
FIG. 13 is a schematic diagram of the hydraulic circuitry.

With reference to FIG. 13, fluid is drawn from a reservoir 115, through a line 116 that has a filter 117 therein, to a pump 118. This pump is driven by a motor 119 through a drive shaft coupling 120. On the discharge side of the pump and branching from the line 116, is a line 121 with a shut off valve 122 therein. This line leads to a pressure gauge 123. A shut off valve 124 is located within the line 116 at a location between the connections of the line 121 and a pressure line 125 that leads to a similar hydraulic circuit for operating a second mobile scaffold on the opposite side of a paint booth. A shut off valve 126 is located within the line 116 between the pressure line 125 and a line 127 that leads to the emergency valve box 59. The line 116 is connected to a push button operated valve 128 that activates the control panel 109. A reservoir return line 129 passes through the valve 128 and this line provides for the return of hydraulic fluid to the reservoir. A pair of shut off valves 130 and 131 are provided in line 129, and a vent line 132 branches off from the line 129 at a location between the shut off valves. The line 132 leads to a similar hydraulic circuit for operating a second mobile scaffold on the opposite side of a paint booth. A filter 133 is provided in the line 116 between the shut off valve 131 and the reservoir.

The control panel actuating valve 128 has an actuating position 134 and a shut off position 135. When this valve is in the actuating position, fluid flows through the line 116 to the travel control valve 110, elevation control valve 111, and the swing control valve 112. The reservoir return line 129 is also connected to these three valves in the control panel. The travel control valve 110 has a forward control position 136 wherein fluid flows from the line 116, through the valve position, to the line 139. The fluid then flows through the motor 50 driving the carriage and the line 140 to the return line 129. This travel control valve has a stop position 137 wherein flow of fluid through the valve is blocked and the motor 50 is stopped. The travel control valve has a reverse position 138 wherein fluid flowing from the line 116 passes through the valve 110, through the line 140, and through the motor 50, to the line 139, from where it returns through the valve 110 to the return line 129.

The elevation control valve 111 is connected to the pressure line 116 by a line 141 and to the return line 129 by the line 142. This valve has an elevating position 143, a hold position 144, and a lowering position 145. The opposite side of this valve is connected by a line 146, through a flow control valve 147, to the hydraulic cylinder 93. When the valve is in the elevating position 143, fluid pressure from the line 116 pressurizes the lines 141 and 146. Pressure in the line 146 causes the actuating arm 94 to be extended from the hydraulic cylinder 93 and thereby elevate the parallel-arm type crane 24. When the elevation control valve 111 is in the hold position 144, pressure is maintained within the hydraulic cylinder and the parallel-arm type crane maintains its elevation. When the elevating control valve is in the position 145, fluid pressure from the hydraulic cylinder 93 is vented through the line 146 and the line 142 that makes connection with the return line 129.

The swing control valve 112 is connected to the pressure line 116 by a line 150 and to the reservoir return line 129 by a line 151. This valve has a swing right position 152, a hold position 153, and a swing left position 154. A line 155 is connected on the opposite side of the valve 112 from the line 150, and a line 156 is connected opposite the valve from the line 151. These lines are provided with flow control valves 148 and 149 and the lines are interconnected through a dual relief valve component 157 that vents excessive pressure in either line. The line 155 is connected to the hydraulic cylinder 74 and the line 156 is connected to the hydraulic cylinder 75. These hydraulic cylinders are interconnected on the opposite side of the piston from the lines 155 and 156 by a line 158. When the valve 112 is in the swing right position 152, fluid from the pressure line 116 pressurizes the line 150 and the line 155 to actuate the hydraulic cylinder 74, thereby extending the cylinder rod 76. At the same time, line 158 and the back side of the piston in hydraulic cylinder 75 is pressurized to retract the cylinder rod 80. Fluid pressure from the hydraulic cylinder 75 at the front of the piston is vented through the line 156, the valve position 152, the line 151, and the line 129 to the reservoir 115. When the swing control valve is in the hold position 153, fluid pressure is maintained in the hydraulic cylinders 74 and 75 so that the cylinder rods 76 and 80 maintain their respective positions. When the swing control valve is in the swing left position 154, pressure from the line 116 pressurizes the line 150, the line 156, and the hydraulic cylinder 75, thereby causing the cylinder rod 80 to be extended from the cylinder. At the same time, line 158 and the back side of the piston within hydraulic cylinder 74 is pressurized to retract the cylinder rod 76. Fluid pressure from the hydraulic cylinder 74 at the front of the piston is vented through the line 155, the valve position 154, the line 151 and the line 129 to the reservoir 115.

A line 160, that branches off from the reservoir return line 129, is connected to a lever operated elevation control valve 161 within the emergency valve box 59. The line 127 is also connected to this valve, which has an elevating position 162, a hold position 163, and a lowering position 164. A control panel by-pass line 165 extends from the opposite side of this valve to the line 146, at a location between the elevation control valve 111 and the flow control valve 147. Operation of the elevation control valve 161 is similar to the operation of the control valve 111 that is by-passed.

A pressure line 167 branches off from the line 127 to a lateral position control valve 168. This valve is also connected to a vent line 169 that branches off from the line 160. This valve has a swing right position 170, a hold position 171, and a swing left position 172. A line 173 connects the valve 168 to the line 155, at a location between the valve 112 and the flow control valve 148. A line 174 connects the valve 168 to the line 156 at a location between the control valve 112 and the flow control valve 149. Operation of the lateral position control valve 168 is similar to the operation of the control valve 112 that is by-passed.

A shut-off valve 176 is provided in the line 132, and a shut-off valve 177 is provided in the line 125. These lines lead to a similar mobile scaffold on the opposite side of the paint booth. The shut-off valves 176 and 177 enable the circuit for the other scaffold to be pressurized or de-activated. The shut-off valves 126 and 130 control pressurization of the control panel 109 and the emergency valve box 59. The shut-off valves 122, 124 and 131 enable sections of line to be isolated for removal of components.

From the foregoing description, it will be seen that the mobile scaffold 20 has the ability to fit within a narrow space. No structure blocks the flow of air beneath the operator's platform. A workman can be positioned at any desired location within an area to be served by the mobile scaffold. The mobile scaffold can be used within an area where there is an extreme fire hazard due to explosive or combustible gases. Manufacture and operation of the mobile scaffold is economically feasible due to its simple structure.

Although the best mode contemplated for carrying out the present invention has been herein shown and described, it will be apparent that modification and variation may be made without departing from what is regarded to be the subject matter of the invention.

What is claimed is:

1. A mobile scaffold comprising a carriage movable along a predetermined path defined by rails on a wall, a vertical shaft rotatably mounted on the carriage, a parallel-arm type crane mounted at one end for swinging about the axis of the vertical shaft, an operator's cage and control panel mounted at the opposite end of the crane, drive means for rotating the vertical shaft, and a drive wheel mounted upon the vertical shaft below the crane to engage one of said rails and apply traction for moving the carriage along the rails.

2. The mobile scaffold described in claim 1 further including control means at the operator's cage and control panel for regulating the carriage travel along the predetermined path, and control means at the operator's cage and control panel for regulating lateral swinging movement of the parallel arm type crane about the axis of the vertical shaft.

3. The mobile scaffold described in claim 2 wherein said parallel arm type crane has a hydraulic cylinder with an actuating arm extending diagonally between the parallel arms for raising or lowering the crane, and the scaffold further includes control means at the operator's cage and control panel for regulating vertical swinging movement of the crane.

4. The mobile scaffold described in claim 3 wherein the wall on which rails define a predetermined path is a side wall of a down-draft paint booth, and the scaffold further includes a fluids manifold mounted upon the carriage, a series of hoses connected between the fluids manifold and sources of fluids at one end of the wall, a series of trolley supported hose hangers, and a series of weighted hose guides that are alternately positioned between the hose hangers, said hoses for supplying paint, solvent, and hydraulic fluid to the fluids manifold from where the hydraulic fluid is dispensed to control movement of the carriage and crane and the paint and solvent are dispensed to the operator's cage and control panel.

* * * * *